US005436536A

United States Patent [19]

Van Der Wilk et al.

[11] Patent Number: 5,436,536

[45] Date of Patent: Jul. 25, 1995

[54] DISPLAY TUBE INCLUDING A CONVERGENCE CORRECTION DEVICE

[75] Inventors: Ronald Van Der Wilk; Jacobus H. T. Jamar; Bernardus H. J. Dekkers; Ronald J. J. De Man, all of Eindhoven, Netherlands

[73] Assignee: U.S. Philips Corporation, New York, N.Y.

[21] Appl. No.: 341,860

[22] Filed: Nov. 18, 1994

Related U.S. Application Data

[63] Continuation of Ser. No. 77,814, Jun. 17, 1993, abandoned, which is a continuation of Ser. No. 874,253, Apr. 24, 1992, abandoned.

[30] Foreign Application Priority Data

May 31, 1991 [EP] European Pat. Off. ..... 91201315

[51] Int. Cl.[6] ..... H01J 29/51

[52] U.S. Cl. ..... 315/368.25; 315/368.28; 335/213

[58] Field of Search ..... 315/368.12, 368.23, 315/368.25, 368.28; 335/213

[56] References Cited

U.S. PATENT DOCUMENTS

| | | | |
|---|---|---|---|
| 3,368,095 | 2/1968 | Jannery | 335/213 |
| 3,466,580 | 9/1969 | Bull | 335/213 |
| 3,702,450 | 11/1972 | Avery et al. | 335/213 |
| 3,754,322 | 8/1973 | Chandler | 335/213 |
| 4,027,219 | 5/1977 | Van Alphen et al. . | |
| 4,642,527 | 2/1987 | Takahashi et al. | 335/213 |
| 4,961,021 | 10/1990 | Oguro et al. | 313/412 |

FOREIGN PATENT DOCUMENTS

| | | |
|---|---|---|
| 0135072 | 7/1984 | European Pat. Off. . |
| 2223124 | 3/1990 | United Kingdom . |
| 8605318 | 9/1986 | WIPO . |

*Primary Examiner*—Theodore M. Blum
*Attorney, Agent, or Firm*—Robert J. Kraus

[57] ABSTRACT

Display tube including a convergence correction device which comprises a plurality of correction coils having coplanar axes and being arranged around the tube neck. The coils are of the planar type. More specifically, there are two sets of four coils for generating two differently oriented four-pole fields and two sets of six coils for generating two differently oriented six-pole fields, while all these coils are arranged on one flexible support which is wound around the tube neck a number of times, for example, one set of coils for each turn.

37 Claims, 5 Drawing Sheets

DISPLAY TUBE INCLUDING A CONVERGENCE CORRECTION DEVICE

This is a continuation of prior application Ser. No. 08/077,814, filed on 17 Jun. 1993, which is a continuation of application Ser. No. 07/874,253, filed on 24 Apr. 1992, both abandoned.

BACKGROUND OF THE INVENTION

The invention relates to a display device having a display robe provided with a display screen and a tube neck located opposite thereto, and including a convergence correction device which comprises an arrangement of correction coils arranged around the neck, and a convergence correction circuit for applying correction currents to the correction coils.

U.S. Pat. No. 4,027,219 describes a device in which eight or twelve coils (solenoids) wound on cores of a ferromagnetic material are arranged in a row around the robe in such a way that their axes are coplanar, while they are incorporated in a circuit having controllable current sources in such a way that, upon energization, two four-pole fields and two six-pole fields are generated whose intensity and polarity are controllable for obtaining (static) convergence.

Drawbacks of the use of such a configuration of solenoids are:

- the insensitivity, requiring a convergence circuit with relatively expensive amplifiers;
- little freedom of design as regards the exact field shape;
- a complicated electric circuit is required to generate all desired multipolar fields with a limited number of coils;
- less suitable for dynamic convergence due to the large inductance of the solenoids.

SUMMARY OF THE INVENTION

It is an object of the invention to provide a construction which does not have at least one of the above-mentioned drawbacks or which has the at least one drawback to a lesser extent.

According to the invention, the display device of the type described in the opening paragraph is therefore characterized in that each correction coil is of the planar wound type and in that the arrangement of correction coils comprises at least a first and a second system of coils each subtending an angle of 360°, each system comprising a plurality of coils which jointly produce; a magnetic 2N-pole field upon energization, with N being 2, 3, etc.

The invention is based on the use of (coreless) coils having (for example concentric) conductor turns which are present on a (cylindrical) surface. This provides the possibility of easily placing a system or a number of systems of such coils in a position close to the neck glass of the display tube (small diameter of the cylinder) so that a high sensitivity is possible. The inductance is low due to the absence of cores. For this concept particularly coils (referred to as print coils) are suitable which are arranged on a surface of a flexible support by means of a printing technique, the support surrounding the tube neck in such a way that the axes of the coils are radially directed towards the axis of the tube neck. All this provides greater freedom of design. More particularly, a separate system of coils can be used for each multipole field to be generated.

For example, two sets of four (print) coils, one for generating a four-pole x field and one for generating a four-pole y field, can be used, combined or not combined with two sets of six of six (print) coils, one for generating a six-pole x field and one for generating a six-pole y field. Each set of coils may be arranged on its own flexible support, while the two sets of coils each producing a four-pole field may be arranged on one and the same flexible support (which is folded or rolled up in such a way that the sets of coils form a winding, one surrounding the other), similarly as the two coils each producing a six-pole fields, or (and preferably) all correction coil systems may be arranged on one and the same flexible support which is wound around the tube a number of times (hereinafter also referred to as foil coil system). In this ease it is important that it should be possible for each set of coils to use the entire circumference of the annular support, in other words, one set of coils for each turn.

As will be described hereinafter, the use of a foil coil system as described above is particularly suitable to be combined with a convergence correction circuit supplying the previously fixed correction currents for a number of positions on the display screen, which currents are associated with said positions. This has, inter alia, the advantage that the correction signal is independent of the deflection frequencies used.

More particularly, such a convergence correction circuit is characterized in that it comprises means for measuring the line deflection current and the field deflection current and for supplying correction currents with reference to the measured currents.

A first, analogous, embodiment is characterized in that the convergence correction circuit includes a multiplier circuit for supplying at least the square, the cube and the fourth power of the deflection currents as output signals.

The correction circuit may include a matrix circuit for multiplying, multiplying by weighting factors and adding the output signals of the multiplier circuit.

A second embodiment is characterized in that the convergence correction circuit includes an A/D converter for digitizing the measured deflection currents, means for digitially computing the correction currents and a D/A converter for supplying the correction currents in an analog form.

A very interesting possibility is presented by incorporating a memory (for example a calibrated (E)EPROM) in the correction circuit, in which memory the corrections are stored which are necessary to correct the convergence errors at a number of measuring points (for example, 25) on the display screen. With this zero convergence option it is possible for the maximum convergence error to be at most 0.2 min.

The coils may be of the planar wound type having concentric external turns surrounding a central window. However, the coils have a greater sensitivity if, in accordance with a preferred embodiment of the invention, they are of the type having external turns surrounding an outer window and internal turns surrounding at least one inner window. The outer and inner window(s) may be concentric or not concentric.

These and other aspects of the invention will be described in greater detail with reference to the embodiments described hereinafter.

DESCRIPTION OF THE PREFERRED EMBODIMENTS

Figure 1:
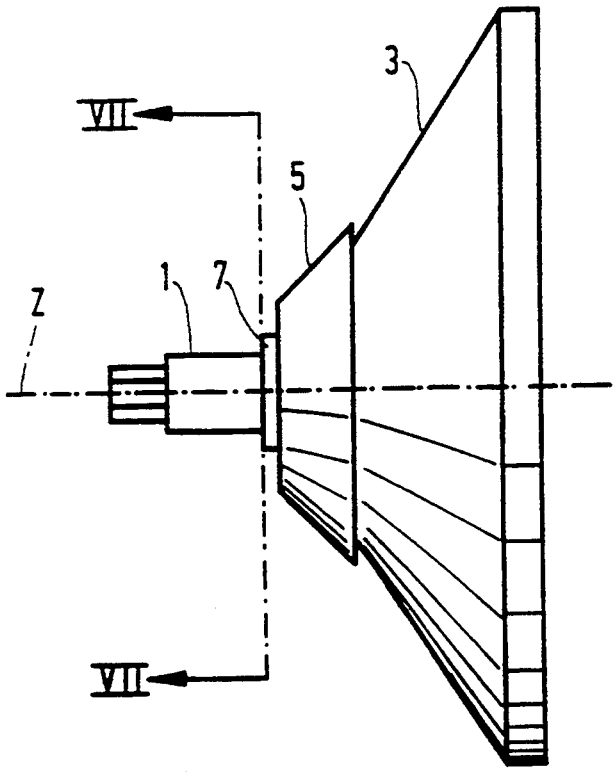
FIG. 1 shows diagrammatically a display device including an arrangement of coils for convergence correction and FIG. 2 shows a larger detail of FIG. 1.
Figure 3A:
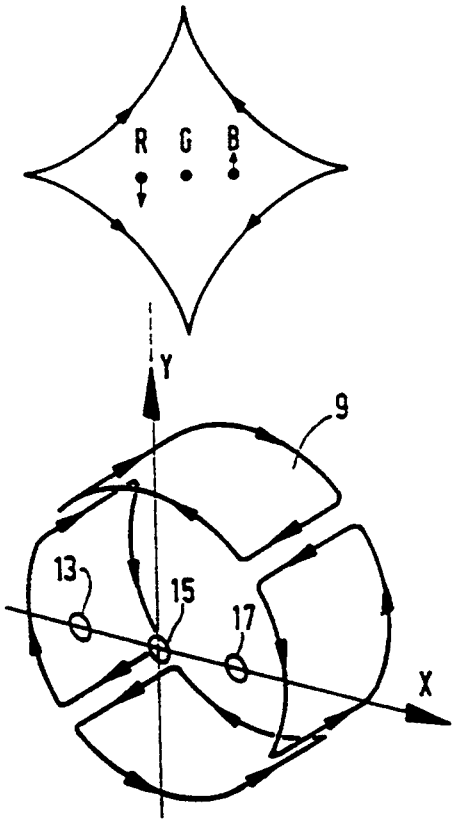
FIGS. 3A and 3B show embodiments of two four-pole field correction coil systems with associated fields for the device shown in FIGS. 1 and 2.
Figure 3B:
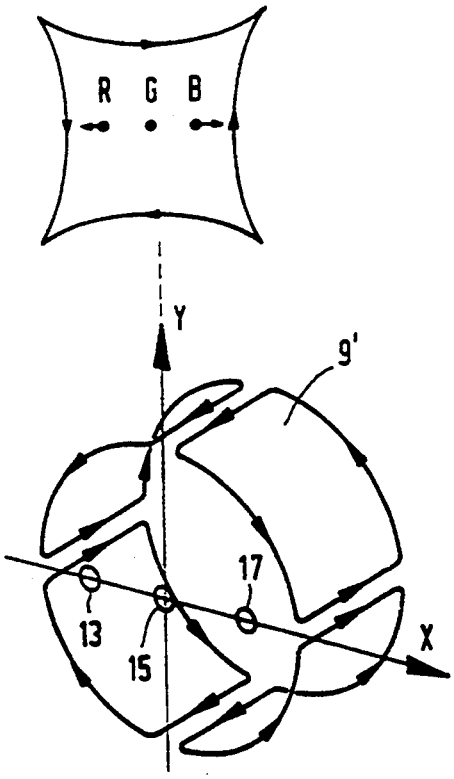

The colour display tube shown diagrammatically in FIG. 1 has a cylindrical neck portion accommodating electron guns (not visible in FIG. 1) for generating three approximately coplanar electron beams, and a funnel-shaped portion 3. A deflection unit 5 which is combined with a convergence correction device 7, is arranged at the area of the interface between the two portions. As is shown in FIGS. 3A and 3B, this correction device may comprise a plurality of coils 9 formed as flat spirals surrounding respective axes which are directed radially towards the axis of the tube neck 1. The coils are arranged in a holder 11 secured to the neck in such a way that their axes are coplanar. When the coils 9 are connected to one or more current sources, magnetic fields resulting in a displacement of the three electron beams 13, 15, 17 arc, generated within the tube neck 1. Red-blue y errors (y astigmatic errors) can be corrected by means of four coils which are positioned and energized in the way as shown in the embodiment of FIG. 3A. Red-blue x errors (x astigmatic errors) can be corrected by means of four coils which are positioned and energized in the way as shown in the embodiment of FIG. 3B. In fact, a four-pole field having a horizontal axis direction produces a vertical displacement of the outer beams 13, 17 in opposite directions (see inset FIG. 3A) and a four-pole field having an axis direction at 45 degrees to the horizontal produces an opposite displacement in the horizontal direction (see inset FIG. 3B).

Figure 10A:
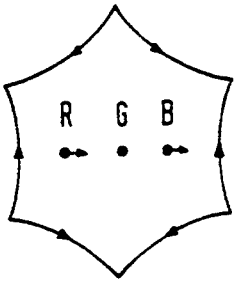
Figure 10B:
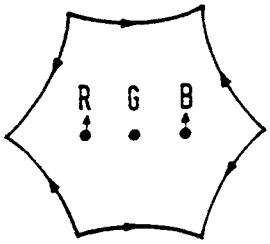

Green-red/blue x errors (x coma errors) (see FIG. 10A) or green-red/blue y errors (y coma errors) (see FIG. 10B) can be corrected by means of six coils which are positioned and energized in the correct way.

As is known, for example, from U.S. Pat. No. 3,725,831, a magnetic six-pole field with an axis in the plane of the three beams 13, 15, 17, i.e. horizontal, produces a simultaneous displacement of the two outer beams R(ed) and B(lue) in a direction perpendicular to the plane of the beams (FIG. 10B), while the central beam 15 is not influenced. A six-pole field, an axis of which is perpendicular to the plane of the three beams (i.e. vertical) thus produces a simultaneous displacement of the outer beams R(ed) and B(lue) towards the left or the fight.

Figure 4:
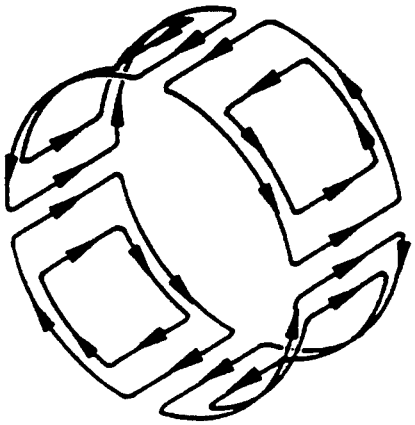
FIG. 4 shows an embodiment of an alternative four-pole field correction coil system.

The embodiment of FIG. 4 shows a coil configuration with four coils having a greater sensitivity. This results from the fact that the coils in question have a given winding distribution, with external turns surrounding an outer window and internal turns surrounding an inner window.

Figure 2:
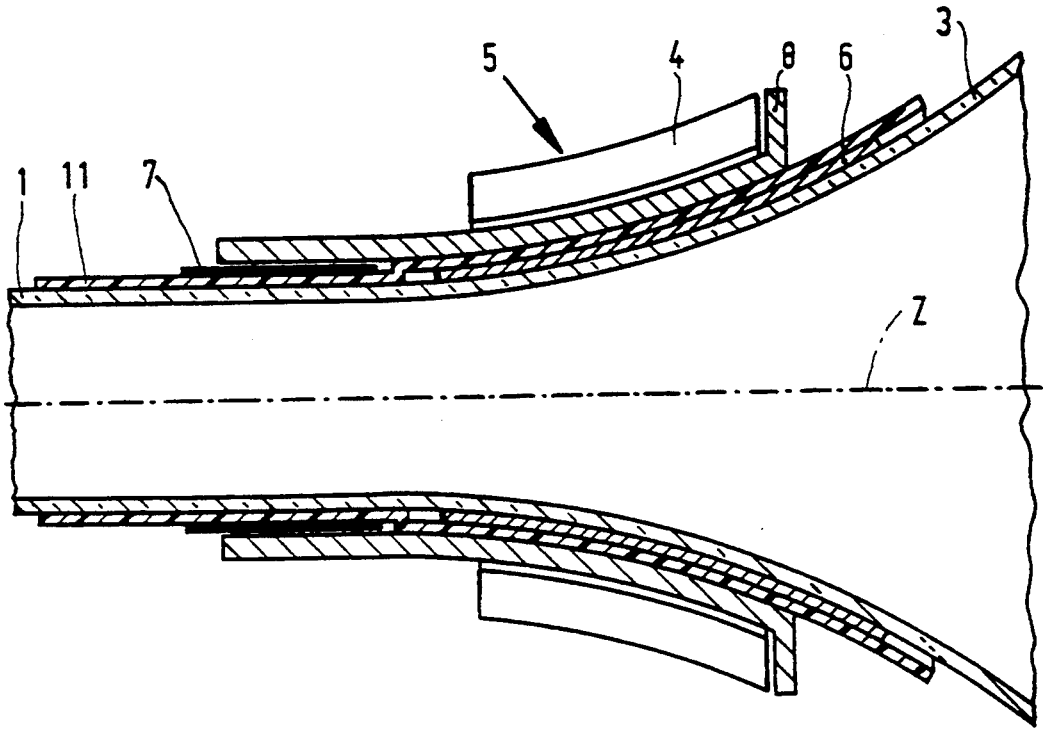

Referring to FIGS. 6A–6D, the conductors required for the correction coils are arranged on an elongate strip of synthetic material foil. The conductors are formed in this case by "multiple" wires with two parallel sub-wires having the desired distribution for four-pole ×(4px), four-pole y (4py), six-pole ×(6px) and six-pole y (6py). The strip, which is illustrated in four parts in connection with the space available for the Figure, is provided with a lead-out 20 to which the multi-pole terminals are connected. The lead-out is arranged as close as possible to the conductors for the 6-poles so as to minimize the ohmic resistance and the inductance in the 6-pole circuits. This is important because the 6-poles have a lower sensitivity than that of the 4-poles. The strip is rolled up on a ring functioning as a support. In this case the strip surrounds the ring four times. The support 7 with the coils (FIG. 5) is subsequently mounted on the deflection unit at the location reserved for this purpose (see FIG. 2) and the lead-out is fixed and provided with a connection to an electric circuit.

Figure 5:
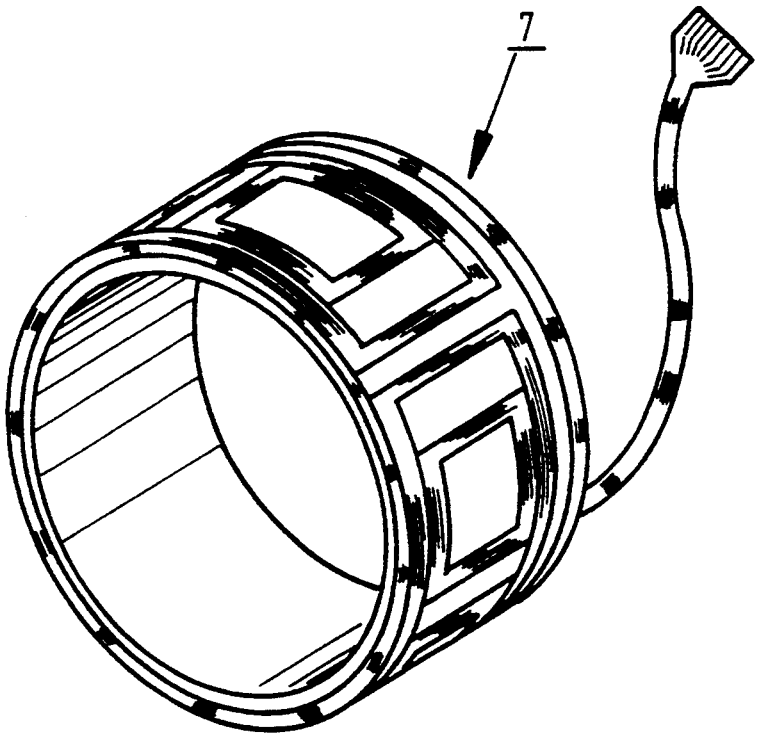
FIG. 5 is a perspective elevational view of a foil coil correction device.
Figure 7:
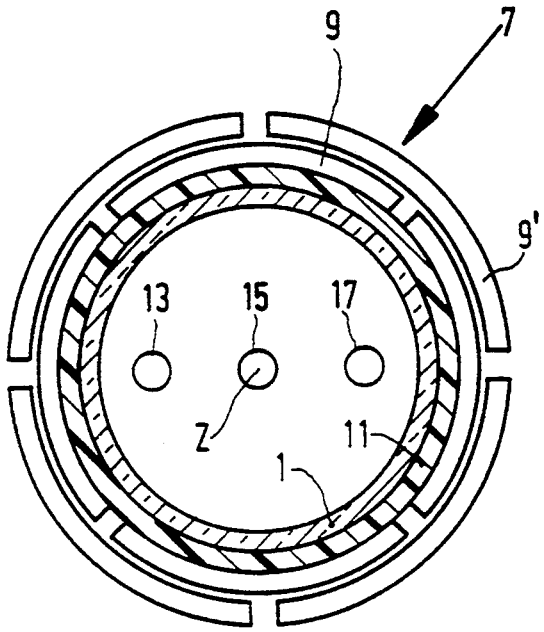
FIG. 7 is a cross-section taken on the line VII—VII of the display tube of FIG. 1.
Figures 6A, 6B, 6C, 6D:
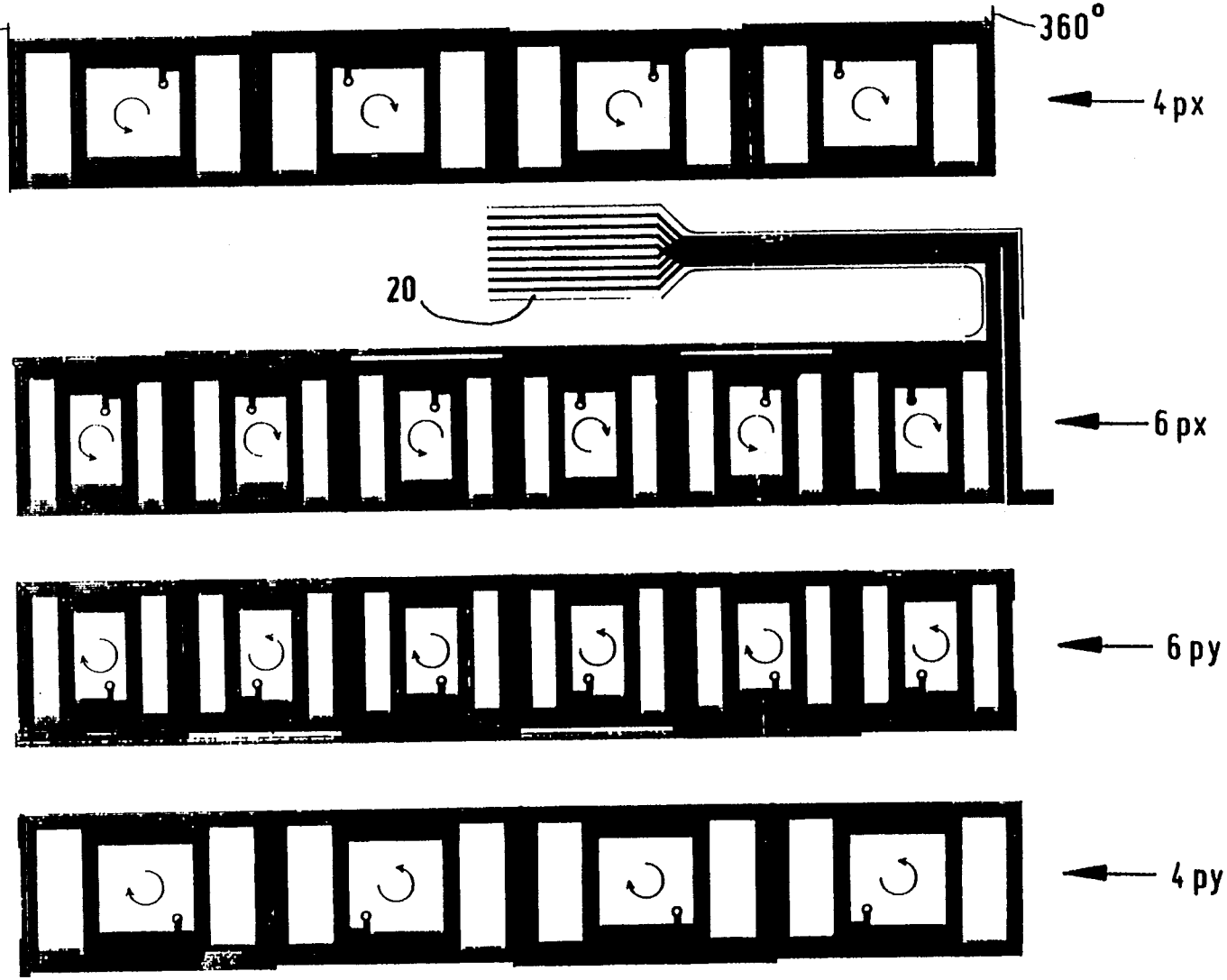
FIG. 6 shows a blank in the flat plane of the foil coil system of FIG. 5.

The arrangement 7 of correction coil systems may be arranged by means of a printing technique on one and the same flexible support which is wound around the tube neck a number of times and which is provided with a plurality of connection conductors connected to a connector (FIG. 5). For example, the ,correction coil systems may be arranged on the lower and upper sides of the flexible support, or all on the same side. The use of the flexible support with printed coils renders it easily possible to arrange the coil systems in (slightly) different axial positions, if so desired.

The coil systems of the above-mentioned convergence correction device are to be connected to an electric circuit which supplies the suitable correction signals.

The use of a foil coil system as described hereinbefore leads to a high sensitivity and a low inductance so that low current intensifies and low voltages are sufficient for correction. One can benefit from this advantage as such and make use of a conventional correction circuit. However, an alternative is to utilize the advantage for designing and using a perfected circuit.

A correction circuit which is very well applicable within the scope of the invention is a circuit supplying correction signals as a function of the instantaneous position of the beam spot on the display screen. In principle, the position of the beam/spot on the screen depends on 3 parameters, namely:

- the horizontal deflection current (line deflection current)
- the vertical deflection current (field deflection current)
- the high voltage.

If the influence of the high-voltage variation can be eliminated or compensated for, there are only two parameters which determine the position of the beam/spot on the display screen. An alternative for determining the position on the display screen of the horizontal and vertical deflection currents is to measure the time which has elapsed after a vertical or horizontal synchronizing pulse. This determination of the position on the display screen by means of a "time measurement" instead of a "current measurement" has the drawback that this measuring method is frequency-dependent. Moreover, working with currents for obtaining the correction signals has the advantage that the supply voltage of the correction circuit may be limited to 5 V. In contrast, if the correction signals are generated on the basis of voltages, the supply voltage must be much higher to obtain a range of amplification which is large enough.

Figure 8:
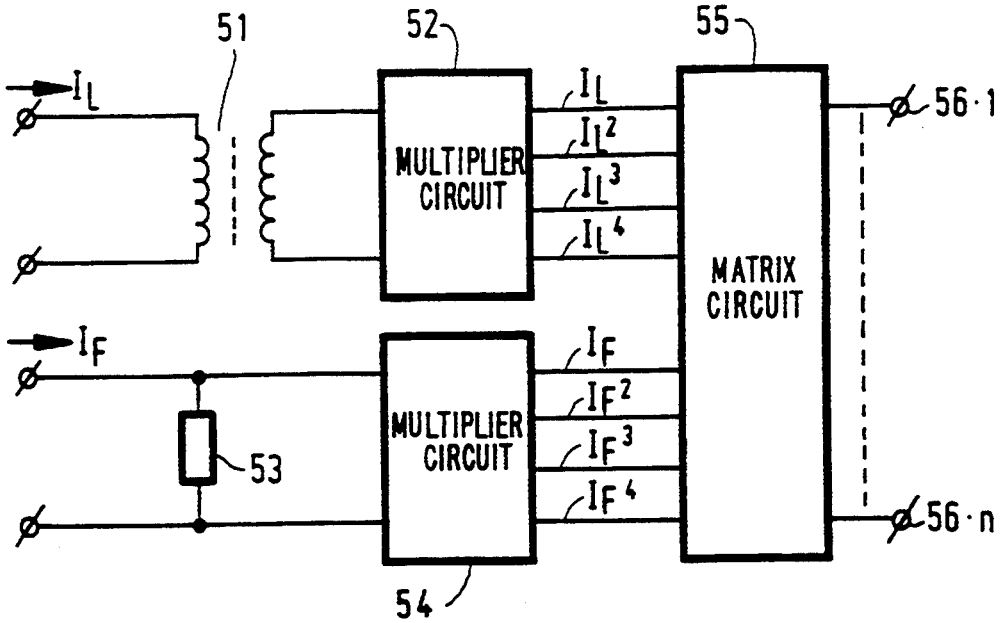
FIGS. 8 and 9 show diagrammatically a convergence circuit for supplying correction currents to the coils of the system of FIG. 5, and FIGS. 10A and 10B show examples of fields generated by sixpole field correction coil systems.

FIG. 8 shows a first embodiment of a correction circuit for correcting, for example, convergence errors on a display screen. With reference to the measured horizontal deflection current It and the measured vertical deflection current $I_f$, the correction circuit determines the position on the screen and computes the required correction current/currents with reference to this position. The current $I_1$ is applied to a multiplier circuit 52 via a current transformer 51. This multiplier circuit supplies $I_1^2$, $I_1^3$ and $I_1^4$ in addition to the measured horizontal deflection current $I_1$. The current $I_f$ flows through a resistor 53. The voltage measured across this resistor is applied to a multiplier circuit 54. Outputs of this multiplier circuit 54 supply also $I_f^2$, $I_f^3$ and $I_f^4$ in addition to the vertical deflection current $I_f$. The outputs of the multiplier circuits 52 and 54 are connected to a matrix circuit 55. In the matrix circuit the required correction currents are obtained by multiplying the currents $I_1$, $I_1^2$, $I_1^3$, $I_1^4$, $I_f$, $I_f^2$, $I_f^3$ and $I_f^4$ by the desired factors and by adding them. The correction currents $Ic_k$(with k=1 . . . n) are supplied at outputs 561 . . . 56n.

The correction current $Ic_k$ has the following shape:

$$Ic_k = \sum_{i=0}^{4} \sum_{j=0}^{4} a_{ij} I_1^i I_f^j, \text{ with } k = 1 \ldots n$$

The weighting factors $a_{ij}$ are determined in advance and determine the weight of each $I_1^i I_f^j$ component in the sum. For each type of display tube/coil combination the factors $a_{ij}$ will have different values. These factors are determined by displaying a known test signal on a relevant display tube/coil combination and by measuring the occurring (convergence) errors at a fixed number of measuring points (for example, 25).

Figure 9:
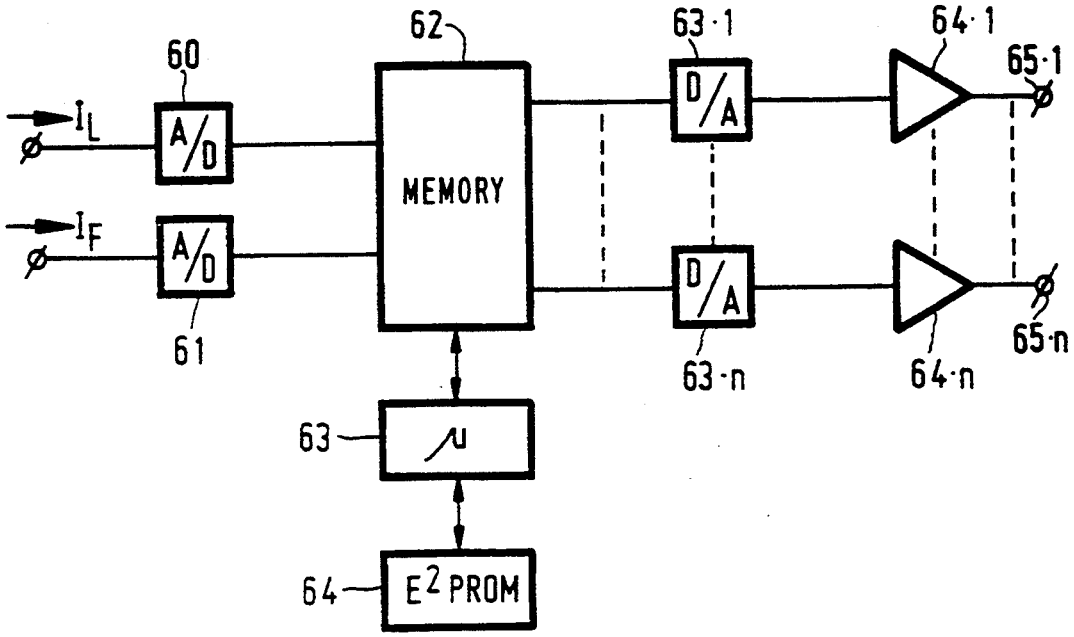

FIG. 9 shows a second embodiment of a correction circuit. In this embodiment the current I, is converted to a digital value in an A/D converter 60 and stored in a memory 62. The current $I_f$ is also converted to a digital value in an A/D converter 61 and stored in the memory 62. A microprocessor 63 reads the stored horizontal and vertical deflection currents from the memory, (with which the location on the display screen is unambiguously determined). The microprocessor receives the correction values associated with this location on the screen from an $E^2$PROM and determines with reference thereto the digital values of the correction currents $Ic_1 \ldots Ic_n$ and applies these values via the memory 62 at outputs to D/A converter 631 . . . 63n. Each D/A converter is connected to an amplifier 641 . . . 64n. Each output of the amplifier is connected to an output terminal 651 . . . 65n of the correction circuit. The analog correction currents are supplied at these output terminals. The output terminals 651 . . . 65n may be connected to correction coils (not shown).

The choice of taking 25 measuring points and determining, with reference thereto, the weighting factors $a_{ij}$ for generating the correction currents also determines the powers of the deflection currents required to determine the correction currents completely. Horizontally, there are 5 measuring points (in the case of 25 measuring points) and hence 5 comparisons. These 5 comparisons are completely determined by means of 5 variables. By taking $I_1^0$, $I_1^1$, $I_1^2$, $I_1^3$ and $I_1^4$, this yields the required 5 variables. Moreover, there are vertically 5 measuring points and hence 5 comparisons. Here again it holds that these 5 comparisons are completely determined by means of 5 variables for which $I_f^0$, $I_f^1$, $I_f^2$, $I_f^3$ and $I_f^4$ are now taken. If there were 36 measuring points, the terms $I_1^5$ and $I_f^5$ would also be necessary, etc.

The correction circuits shown in FIGS. 8 and 9 may supply correction signals for dynamic convergence throughout the display screen. These correction circuits could also be used for other required corrections, for example, other location error corrections such as pincushion/barrel correction.

We claim:

1. A display device having a display tube provided with a display screen and a tube neck located opposite thereto, and including a convergence correction device which comprises an arrangement of correction coils arranged around the neck, and a convergence correction circuit for applying correction currents to the correction coils, characterized in that each correction coil is of the planar wound type and in that the arrangement of correction coils comprises at least a first and a second system of coils each subtending an angle of 360°, each system comprising a plurality of coils which jointly produce a magnetic 2N-pole field upon energization, where N is greater than 1.

2. A device as claimed in claim 1, characterized in that the systems of correction coils are arranged around each other.

3. A device as claimed in claim 1, characterized in that the systems of correction coils are arranged on a common flexible support (19) arranged around the tube neck (1), which support is wound around the tube neck in a layered arrangement.

4. A device as claimed in claim 3, characterized in that one set of coils is provided for each layer.

5. A device as claimed in claim 1, characterized in that the convergence correction circuit supplies correction currents which are a function of the instantaneous position of the beam spot on the display screen.

6. A device as claimed in claim 1, characterized in that the convergence correction circuit comprises means for measuring the line deflection current and the field deflection current and for supplying correction currents with reference to the measured currents.

7. A device as claimed in claim 6, characterized in that the convergence correction circuit includes a multiplier circuit for supplying at least the square, the cube and the fourth power of the deflection currents as output

8. A device as claimed in claim 7, characterized in that the convergence correction circuit includes a matrix circuit for multiplying the output signals of the multiplier circuit by weighting factors and adding the resulting products.

9. A device as claimed in claim 6, characterized in that the convergence correction circuit includes an A/D converter for digitizing the measured deflection currents, means for digitally computing the correction currents and a D/A converter for supplying the correction currents in an analog form.

10. A device as claimed in claim 9, characterized in that the convergence correction circuit is coupled to a memory in which the weighting factors are stored which are dependent on the type of display tube.

11. A display device having a display tube including a convergence correction device which comprises an annular support supporting a plurality of correction coils having coplanar axes, and a convergence correction circuit for applying correction currents to the coils, characterized in that each coil comprises a plurality of coannular turns surrounding a window and in that the support comprises at least a first and a second non-magnetic sub-support, one on top of the other, each subtending an angle of 360°, each sub-support supporting a plurality of coils which jointly produce at least one magnetic 2N-pole field upon energization, where N is greater than 1.

12. A display device having a display tube provided with a display screen and a tube neck located opposite thereto, and including a convergence correction device which comprises an arrangement of correction coils arranged around the neck, and a convergence correction circuit for applying correction currents to the correction coils, characterized in that the arrangement of correction coils comprises at least a first and a second system of coils, each said system of coils comprising a plurality of coils which are disposed around the neck, lie flatly on a surface surrounding the neck, and jointly produce a magnetic 2N-pole field upon energization, where N is greater than 1.

13. A device as claimed in claim 12, characterized in that the first and second systems of correction coil are arranged around each other.

14. A device as claimed in claim 12, characterized in that the first and second systems of correction coils are arranged on a common flexible support arranged around the tube neck, which support is wound around the tube neck in a layered arrangement.

15. A device as claimed in claim 14, characterized in that one of the first and second systems of coils is provided for each layer.

16. A device as claimed in claim 12, characterized in that the convergence correction circuit supplies correction currents which are a function of the instantaneous position of the beam spot on the display screen.

17. A device as claimed in claim 12, characterized in that the convergence correction circuit comprises means for measuring the line deflection current and the field deflection current and for supplying correction currents with reference to the measured currents.

18. A device as claimed in claim 17, characterized in that the convergence correction circuit includes a multiplier circuit for supplying at least the square, the cube and the fourth power of the deflection currents as output signals.

19. A device as claimed in claim 18, characterized in that the convergence correction circuit includes a matrix circuit for multiplying the output signals of the multiplier circuit by weighting factors and adding the resulting products.

20. A device as claimed in claim 17, characterized in that the convergence correction circuit includes an A/D converter for digitizing the measured deflection currents, means for digitally computing the correction currents and a D/A converter for supplying the correction currents in an analog form.

21. A device as claimed in claim 20, characterized in that the convergence correction circuit is coupled to a memory in which the weighting factors are stored which are dependent on the type of display tube.

22. A display device having a display tube including a convergence correction device which comprises an annular support supporting a plurality of correction coils having coplanar axes, and a convergence correction circuit for applying correction currents to the coils, characterized in that each coil comprises a plurality of turns arranged on a portion of a substantially cylindrical surface and surrounding a window and in that the support comprises at least a first and a second non-magnetic sub-support, one on top of the other, and subtending an angle of 360°, each sub-support supporting a plurality of coils which jointly produce at least one magnetic 2N-pole field upon energization, where N is greater than 1.

23. A display device having a display tube provided with a display screen and a tube neck located opposite thereto, said display device including a convergence correction device which comprises an arrangement of correction coils disposed around the neck, characterized in that the arrangement of correction coils comprises at least a first and a second system of coils, each said system of coils comprising a plurality of coils which are disposed around the neck, lie flatly on a surface surrounding the neck, and jointly produce a magnetic 2N-pole field upon energization, where N is greater than 1.

24. A convergence correction device for a display device having a display tube provided with a display screen and a tube neck located opposite thereto, said convergence correction device comprising an arrangement of correction coils disposed around the neck and a convergence correction circuit for applying correction currents to the correction coils, characterized in that the arrangement of correction coils comprises at least a first and a second system of coils, each said system of coils comprising a plurality of coils which are disposed around the neck, lie flatly on a surface surrounding the neck, and jointly produce a magnetic 2N-pole field upon energization, where N is greater than 1.

25. A display device having a display tube including a convergence correction device which comprises an annular support supporting a plurality of correction coils having coplanar axes, characterized in that each coil comprises a plurality of turns arranged on a portion of a substantially cylindrical surface and surrounding a window and in that the support comprises at least a first and a second non-magnetic sub-support, one on top of the other, and subtending an angle of 360°, each sub-support supporting a plurality of coils which jointly produce at least one magnetic 2N-pole field upon energization, where N is greater than 1.

26. A convergence correction device for a display device having a display tube, said convergence correction device comprising an annular support supporting a plurality of correction coils having coplanar axes and a convergence correction circuit for applying correction currents to the coils, characterized in that each coil comprises a plurality of turns arranged on a portion of a substantially cylindrical surface and surrounding a window and in that the support comprises at least a first and a second non-magnetic sub-support, one on top of the other, and subtending an angle of 360°, each sub-support supporting a plurality of coils which jointly produce at least one magnetic 2N-pole field upon energization, where N is greater than 1.

27. A display device having a display tube for producing central and first and second outer electron beams lying in one plane, said tube including a display screen and a tube neck located opposite thereto, said display device including means for deflecting the electron beams across the screen, a convergence correction device which comprises an arrangement of correction coils arranged around the tube neck and a convergence correction circuit for applying correction currents to the correction coils, characterized in that the arrangement of correction coils comprises at least a first and a second system of coils arranged around each other, each system of coils subtending an angle of 360°, and each system of coils comprising a plurality of 2N coils which jointly produce a magnetic 2N-pole field upon energization, where N is greater than 1, for displacing the outer beams relative to the central beam, that the turns of each correction coil are arranged on a portion of a substantially cylindrical surface, and that the correction coils are coreless.

28. A display device as in claim 27, characterized in that the systems of correction coils are arranged on a circumferential surface of a common flexible support arranged around the tube neck, which support is wound around the tube neck in a layered arrangement.

29. A display device as in claim 27, characterized in that the first system of coils comprises 4 coils for producing a four-pole field having an x-axis in a first direction and the second system of coils comprises 4 coils for producing a four-pole field having a y-axis in a second direction transverse to the first direction.

30. A display device as in claim 27, characterized in that the arrangement of correction coils further comprises a third system of coils comprising 6 coils for producing a six-pole field having an x-axis in a first direction and a fourth system of coils comprising 6 coils for producing a six-pole field having a y-axis in a second direction transverse to the first direction.

31. A display device as in claim 27, characterized in that the convergence correction circuit supplies correction currents which are a function of the instantaneous position of a luminescent spot formed on the display screen by at least one of said electron beams.

32. A display device as in claim 27, characterized in that the means for deflecting the electron beams comprise line and field deflection coil systems and the convergence correction circuit comprises means for measuring deflection currents in said deflection coil systems and for supplying correction currents with reference to the measured deflection currents.

33. A display device as in claim 32, characterized in that the convergence correction circuit includes a multiplier circuit for supplying at least the square, the cube and the fourth power of the measured deflection currents as output signals.

34. A display device as in claim 33, characterized in that the convergence correction circuit includes a matrix circuit for multiplying the output signals of the multiplier circuit by weighting factors and adding the resulting products.

35. A display device as in claim 32, characterized in that the convergence correction circuit includes an A/D converter for digitizing the measured deflection currents, means for digitally computing the correction currents and a D/A converter for supplying the correction currents in an analog form.

36. A display device as in claim 35, characterized in that the convergence correction circuit is coupled to a memory in which weighting factors are stored which are dependent on the type of display tube.

37. A display device having a display tube for producing central and first and second electron beams lying in one plane, said display device including a convergence correction device which comprises an annular support supporting a plurality of correction coils whose axes are coplanar, and a convergence correction circuit for applying correction currents to the correction coils, characterized in that the support comprises at least a first and a second non-magnetic sub-support, one on top of the other, each subtending an angle of 360°, each sub-support supporting a plurality of coils arranged around each other which jointly produce at least one magnetic 2N-pole field upon energizing, where N is greater than 1, for displacing the outer beams relative to the central beam, that each coil comprises a plurality of turns arranged on a portion of a substantially cylindrical surface and surrounding a window, and that the correction coils are coreless.

* * * * *